US006282812B1

(12) United States Patent
Wee et al.

(10) Patent No.: US 6,282,812 B1
(45) Date of Patent: Sep. 4, 2001

(54) MULTI AIR-KNIFE BOX AND METHOD OF USE

(75) Inventors: Hwee Nam Wee, Singapore (SG); Peter Hock Ming Ng, Johor (MY); Sean Shiao Shiong Chong, Singapore (SG)

(73) Assignee: St Assembly Test Services Pte Ltd., Singapore (SG)

( * ) Notice: Subject to any disclaimer, the term of this patent is extended or adjusted under 35 U.S.C. 154(b) by 0 days.

(21) Appl. No.: 09/467,112

(22) Filed: Dec. 20, 1999

(51) Int. Cl.[7] ..... F26B 3/00

(52) U.S. Cl. ..... 34/464; 34/508; 34/207; 34/210; 34/216; 34/217; 34/232; 34/236; 34/241; 228/223; 228/20.1

(58) Field of Search ..... 34/419, 451, 464, 34/508, 207, 210, 215, 216, 217, 218, 232, 236, 241; 228/223, 19, 20.1

(56) References Cited

U.S. PATENT DOCUMENTS

| | | | | |
|---|---|---|---|---|
| 5,103,846 | | 4/1992 | Clark et al. | 134/57 R |
| 5,240,018 | | 8/1993 | Clark et al. | 134/64 R |
| 5,379,943 | * | 1/1995 | Gibson | 228/20.1 |
| 5,494,529 | * | 2/1996 | Ciccarelli et al. | 134/15 |
| 5,722,582 | | 3/1998 | Gibson | 228/223 |
| 5,916,374 | | 6/1999 | Casey et al. | 134/37 |
| 5,971,246 | * | 10/1999 | Aun et al. | 228/1.1 |
| 6,108,938 | * | 8/2000 | Jones | 34/487 |

* cited by examiner

*Primary Examiner*—Pamela Wilson
(74) *Attorney, Agent, or Firm*—George O. Saile; Stephen B. Ackerman

(57) ABSTRACT

An apparatus is provided for the drying of electronic components. The invention provides multiple holes through which air is passed before striking the components. This provides the apparatus of the invention with multiple air knives, thereby breaking major air flow into multiple eddy currents whereby these eddy currents have a low enough air pressure gradient such that the electronic components are not damaged or lifted from the conveyer belt on which they are transported.

12 Claims, 3 Drawing Sheets

FIG. 1 – Prior Art

MULTI AIR-KNIFE BOX AND METHOD OF USE

BACKGROUND OF THE INVENTION

1. Field of the Invention

The invention relates to the fabrication of integrated circuit devices, and more particularly, to an apparatus for drying semiconductor components as part of their processing sequence.

2. Description of the Prior Art

In the field of high density interconnect technology, it is necessary to fabricate a multilayer structure on the substrate to connect integrated circuits to one another. To achieve a high wiring and packing density, many integrated circuit chips are physically and electrically connected to a single substrate commonly referred to as a multi-chip module (MCM). Typically, layers of a dielectric such as a polyimide separate metal power and ground planes in the substrate. Embedded in other dielectric layers are metal conductor lines with vias (holes) providing electrical connections between signal lines or to the metal power and ground planes. Adjacent layers are ordinarily formed so that the primary signal propagation directions are orthogonal to each other. Since the conductor features are typically narrow in width and thick in a vertical direction (in the range of 5 to 10 microns thick) and must be patterned with microlithography, it is important to produce patterned layers that are substantially flat and smooth (i.e., planar) to serve as the base for the next layer.

Surface mounted, high pin count integrated circuit packages have in the past been configured using Quad Flat Packs (QFP's) with various pin configurations. These packages have closely spaced leads for making electrical connections distributed along the four edges of the flat package. These packages have become limited by being confined to the edges of the flat package even though the pin to pin spacing is small. To address this limitation, a new package, a Ball Grid Array (BGA) is not so confined because the electrical contact points are distributed over the entire bottom surface of the package. More contact points can thus be located with greater spacing between the contact points than with the QFP's. These contacts are solder balls that facilitate flow soldering of the package onto a printed circuit board.

A Ball Grid Array (BGA) is an array of solderable balls placed on a chip carrier. The balls contact a printed circuit board in an array configuration where, after reflow, the balls connect the chip to the printed circuit board.

Interconnecting lines and vias are planarized by multiple coatings of a dielectric material such as polyimide which are used to achieve an acceptable degree of planarization. Application of multiple coatings of thick polyimide is time-consuming and creates high stress on the substrate.

Chemical solutions have been used extensively for the manufacture of semiconductor devices. Wet chemical processing baths have been used for cleaning semiconductor wafers, as well as for etching deposited films on these wafers. For example, the use of hydrogen peroxide ($H_2O_2$), containing solutions for cleaning silicon semiconductor wafers, is well known. In addition to wafer cleaning, hydrogen peroxide is utilized in combination with sulfuric acid for photoresist removal and in combination with phosphoric acid, sulfuric acid or ammonium hydroxide for selective titanium etching.

At most semiconductor fabrication facilities, liquid processing baths are used for a certain time period and then discarded. This practice not only results in high chemical costs, but it also leads to the generation of more waste than would be required. Environmentally, it is preferred to reduce such waste.

In more advanced manufacturing facilities, automated controllers are utilized to achieve some degree of chemical composition control. These controllers spike the bath with certain chemicals at predefined intervals and can also add one or more chemicals to the bath to make up for a drop in the bath liquid level. With the exception of liquid level sensors, no analytical instrumentation is employed to provide feedback for guiding the chemical composition adjustment process. Thus, departure from "normal" operating conditions is not detected, nor are appropriate corrective actions taken.

After semiconductor devices have been attached to a substrate, the substrate is cleaned to remove any remaining residue from the surface of the board. This process typically involves washing of the substrate in a solvent that is selected such that residue on the surface of the board is dissolved in the solvent after which the solvent is removed from the cleaning apparatus. This however results in a solvent that may contain chemicals that are harmful to the environment, which requires special treatment of the solvent solution. One of the methods that is used to prevent impurities in a solvent is to apply solid carbon dioxide ($CO_2$) particles to the surface that needs to be cleaned. These particles, upon striking the surface that needs to be cleaned, sublimate in the process of which residue on the surface of the board is absorbed and removed from that surface. The use of $CO_2$ however does result in the build-up of an electrostatic charge on the surface of the board that is being cleaned. This electrostatic charge must either be prevented from building up or must be removed before the board is passed on to further processing steps. The former can be accomplished by grounding the board while it is being treated by the $CO_2$, the latter can at least partially be accomplished by mixing the $CO_2$ with another substance, such as a water mist, that prevents or alleviates the accumulation of the electrostatic charge during the cleaning process.

Solvents that are used to clean semiconductor device packages must meet a number of requirements that relate to both the effectiveness of the cleaning operation and to the toxicity of the waste products that are produced during the cleaning operation. The by-products of the cleaning operation must not result in products that are contaminating, difficult to degrade, have a long retention period and have in any other way an undesirable impact on the environment in which they are deposited. For these reasons, chlorinated hydrocarbon and chlorofluorinated solvents have largely been abandoned even though these substances have excellent qualities as solvents of rosin flux and other by-products of solder operations. In recent years, terpene compounds appeared to offer an attractive alternative to the previous generation of solvents, this because terpene compounds offer significant advantages for the cleaning operation. It is for instance known that terpene compounds are widely available and are safe enough that they have seen use as a food additive. Terpene compounds are also readily biodegradable and can readily be handled be regular waste disposal facilities. Terpene compounds can be applied under room temperature; they are not volatile and have a boiling point that is considerably higher than halogenated solvents. Furthermore, terpene compounds can penetrate between densely mounted components and can therefore provide excellent cleaning of surfaces of high density. While the indicated advantages of terpene compounds are considerable, terpene compounds however have the disadvantage that they are flammable under relatively low temperatures (100 to 200 degrees F.) and that they readily solidify when brought into contact with water. Terpene compounds further have a profoundly objectionable odor while terpene compounds, because they are not volatile, must be rinsed away after application. This process of rinsing however can readily result in the gelling of the terpene compounds, which makes the process of removal of the terpene compounds cumbersome.

One of the more frequently used type of apparatus for cleaning printed circuit board using terpene compounds is manufactured by the Vitronics Corporation of Newmarket, N.H. U.S. Pat. Nos. 5,103,846 and 5,240,018 detail such an apparatus as marketed by the Vitronics Corporation. The apparatus of invention U.S. Pat. Nos. 5,103,846 and 5,240,018 includes three different components, a first housing that contains the terpene washing apparatus, a second housing that contains a water rinsing apparatus and an intermediate conveying means for transporting the devices from the first housing to the second housing. The intermediate conveying means is positioned at an angle such that the end facing the second housing is positioned lower than the first end. Exhaust fans are provided for the first housing to prevent escape of terpene odors or vapor s, similar fans in the second housing prevent the escape of water vapor. Scrubbers are provided in the exhaust ducts from the first housing that prevent terpene compounds from escaping into the atmosphere. A flame detector is provided that prevents the introduction of boards that have either an open flame on the surface or that are of too high a temperature. The temperature of the terpene vapor is controlled by a series of temperature controls to prevent the terpene vapors from igniting.

The current aqueous cleaner and drying cycle for the Vitronics cleaner uses a five air-knife manifold for drying the flip chip assemblies. Of the five air-knives, three are top air-knives and two are bottom air-knives. The flip chip assemblies that are dried using this apparatus can be singulated semiconductor devices or they can be strip mounted, multiple devices. During the drying process, the Vitronics cleaner has a hold-down belt that keeps the parts that are being cleaned in a downward position. High pressure blowing (air circulation) is applied to the parts that are being cleaned during the drying and cleaning process, this high pressure blowing can result in individual devices being lifted up from the carrier belt on which they are transported. This and other problems that are experienced with the current process of blow-drying assemblies of electrical components will be subsequently highlighted.

The invention addresses the problems that are at this time associated with the drying of semiconductor assemblies while these assemblies pass through a drying chamber. It must be emphasized in this context that the term air is used in the broad sense of the word in that not only air but also any other suitable drying gas can be applied during the drying operation using the apparatus of the invention.

Referring now to FIG. 1, there is shown a cross section of a drying station of the Prior Art that demonstrates components being dislodged from their position in addition to being scratched. A unit 10 of an electrical assembly, typically an assembly such as an BGA package on which a number of electrical components such as semiconductor devices, capacitors, filters and the like have been assembled, is passed through the drying station of the cross section. Most electrical assemblies that are passed through the apparatus that is shown in cross section in FIG. 1 are singulated assemblies of a relatively small physical nature that have previously been processed in strip form. The main belt 18 of the station is provided with rotating motion 34 by means of a rotary motor (not shown), the component 10 that is being dried is positioned on top of belt 18. Supports 16 are provided to essentially separate belt 18 from belt 14. Belt 14 is driven in direction 36 so that both belts 14 and 18 move in the same direction as the component 10. Belt 18 is the bottom belt of the drying station; belt 14 is the top or hold-down belt of the drying station. Belt section 20 is the return trajectory of belt 18 while belt section 12 is the return trajectory of belt 14. While component 10 is positioned between belts 14 and 18, the component undergoes the process of drying. The component 10 is, as part of the drying process, blown dry by the high pressure air-knife manifolds 24 and 26 that are mounted respectively above and below the component 10 as it passes through the station. Air-knife manifolds 24 and 26 create a high-pressure airflow (not shown). It must be noted that air-knife manifolds 24 directs the air in a downward direction thus striking the top surface of the assembly 10 while air-knife manifolds 26 direct the air at the assembly 10 in an upward direction thus striking the bottom of the assembly 10. The high-pressure airflow is further directed at the surface of the assembly by airflow directors 25 that force the air to strike the surface of the assembly in concentrated form. This high-pressure airflow therefore strikes the components that are mounted on the assembly 10 with considerable force thereby potentially dislodging these components from the assembly 10. It must be noted that this prior art drying station uses two belts for the transport of the assembly 10. The top hold-down belt 12 is under tension in section 14 of the belt where the belt passes over or is close to passing over assembly 10. The two belts of the drying station are required because of the dual direction (up and down) under which the air-knives direct air at the assembly. Belt 14 therefore offsets the upward pressure that is exerted by the air-knife manifolds 26 while belt 18 offsets the downward pressure that is exerted by the air-knife manifolds 24.

The cutout 28 indicates that, within the final section of the passage of assembly 10 through the station, components 36, 38 and 39 have been dislodged thereby having a serious negative yield impact on the process of drying the assembly 10.

U.S. Pat. No. 5,240,018 (Clark et al.) assigned to Vitronics—teaches a cleaner having air knives.

U.S. Pat. No. 5,916,374 (Casey et al.) shows a mask cleaner with air knives on both sides of the mask being cleaned.

U.S. Pat. No. 5,103,846 (Clark et al.)—assigned to Vitronics—teaches cleaning tool having air knives above the part see FIG. 3, col. 12, line 48.

U.S. Pat. No. 5,722,582 (Gibson) shows a hot air circulation for a soldering machine using air knives.

SUMMARY OF THE INVENTION

A principle objective of the invention is to provide an apparatus for drying electronic components whereby these components can be dried using a unique method of introducing air into the drying apparatus whereby the flow of the components through the cleaning apparatus is not impacted by the flow of the air.

Another objective of the invention is to provide an apparatus for drying electronic components whereby the components are firmly secured in place during the process of drying.

Another objective of the invention is to provide an apparatus for drying electronic components whereby the components are not scratched or otherwise damaged during the process of drying.

In accordance with the objectives of the invention, a new apparatus is provided for the drying of electronic components. Prior Art uses five air-knives to direct high-pressure air flow at the components that are being dried, that is three air-knives that are mounted above the component assembly that is being dried and two air-knives that are mounted below the component assembly that is being dried. The invention replaces to top mounted three air-knives assembly and provides in its place a multiple air-knives box that has multiple holes through which the air is passed before striking the components. The multiple air-knives of the invention break the major air flow into multiple eddy currents whereby these eddy currents have a low enough air pressure gradient such that the electronic components are not damaged or lifted from the conveyer belt on which they are transported. In addition, the apparatus of the invention has eliminated a hold-down belt thereby removing a significant contributor to component damage.

DESCRIPTION OF THE PREFERRED EMBODIMENTS

A typical BGA package is cleaned during the final manufacturing stages using a water-soluble flux whereby cleaning procedures are used that are equally applicable to PCB cleaning. The apparatus of the invention addresses problems that have been encountered following these procedures. The apparatus of the invention provides a new air-knife concept that allows for the effective and damage free cleaning of small electronic assemblies.

During the process of BGA ball flow and attach, flux is used for the cleaning of the oxide from the solder balls and the surface of the ball pad. The flux that is used is prone to introduce ionic contamination of the packaged components, which can have a serious detrimental effect on product yield and is therefore a serious concern. In addition, additives that are frequently made part of the flux are often difficult to remove. Water-soluble flux is therefore the preferred medium in cleaning electronic assemblies. The key requirement for the cleaning process is that the flux is completely removed from the assemblies and from the solder balls and from the substrate on which the components are mounted. The invention addresses a high-pressure spraying system that is used for the cleaning of electronic assemblies.

BGA assemblies are typically processed in one of two forms, that is in strip form (containing multiple BGA packages) or as singulated units (containing only one BGA package). When BGA assemblies are processed in singulated form, a carrier belt is used to transport the singulated units through the aqueous cleaning system.

The problems that are typically experienced during high-pressure cleaning of electronic assemblies can be summarized as follows:

- a hold-down belt that is in place above the processed BGA assemblies exerts excessive pressure on the assemblies resulting in damage to the balls of the units
- strong pressure exerted by the air flow of the presently in place two air-knife assembly tends to push the assemblies from the transporting belt, and
- the combination of transport belt and hold-down belt frequently interferes with linear and orderly transport of the assembly with the result that the assembly is dragged along the transport belt resulting in scratching of the assembly or other damage to the assembly. Identification ink markings that have been applied to the surface of the assembly are in this manner frequently made illegible.

Figure 1:
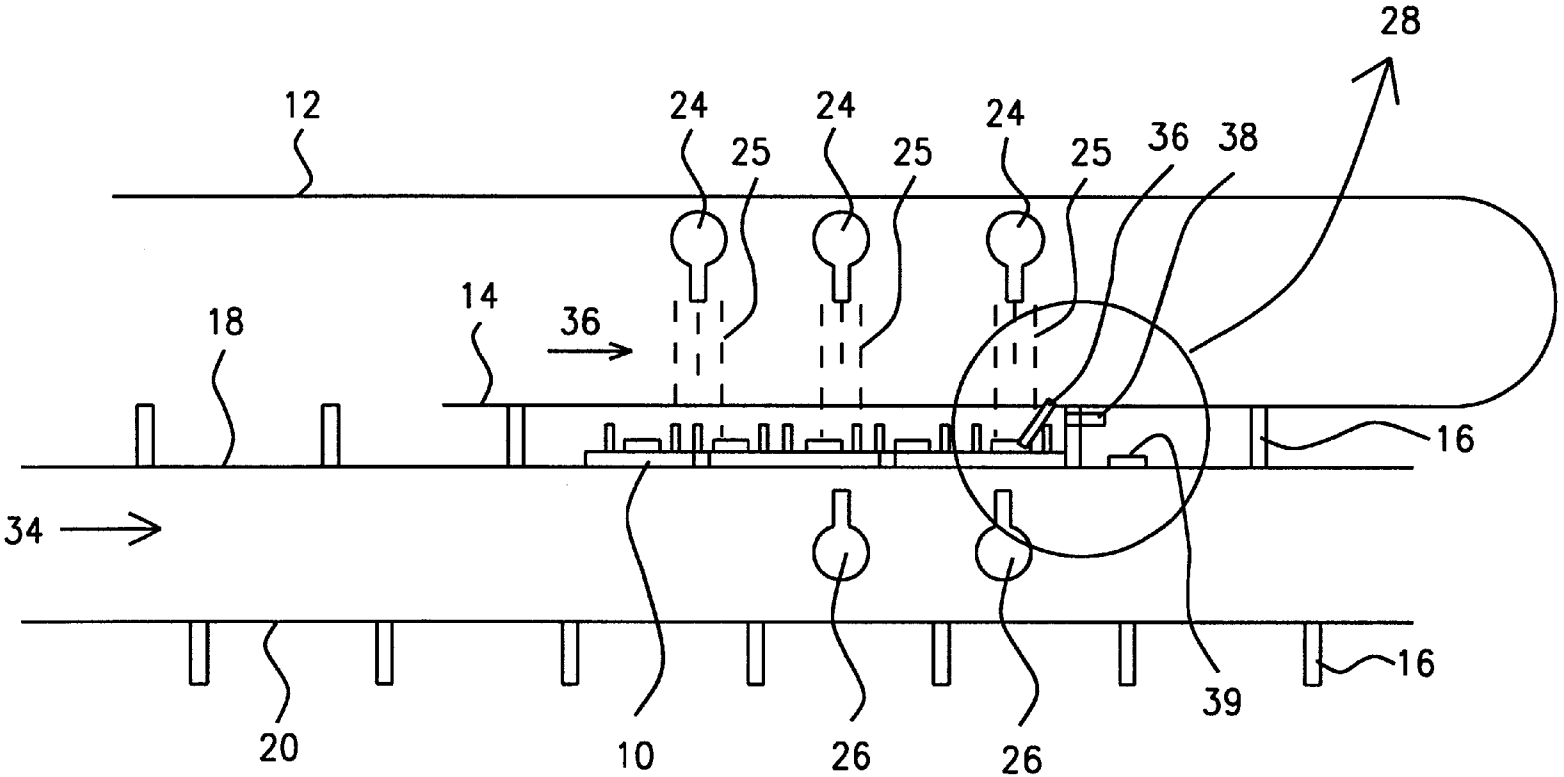
FIG. 1 shows a cross section of a drying station of the Prior Art that demonstrates components being dislodged from their position in addition to being scratched.
Figure 2:
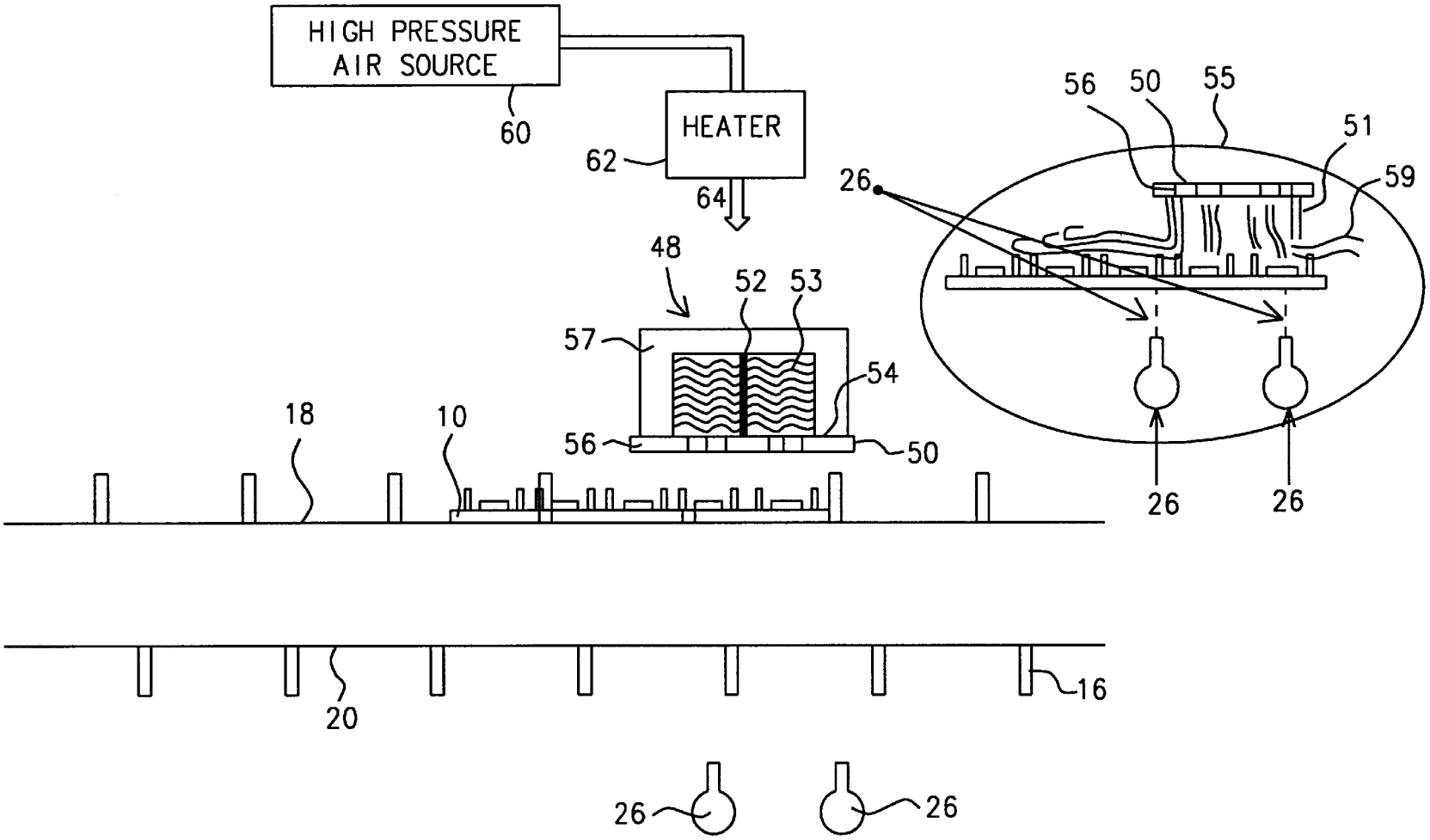
FIG. 2 shows a cross section of a drying station of the invention that demonstrates the removal of the top belt and the installation of a new, multiple air-knife air distribution box.

FIG. 2 shows a cross section of the drying station of the invention. The high pressure, relatively large air-knife manifolds of conventional design have been partially replaced with a new air-knife box that contains multiple air-knives. The air-knife box of the invention takes the place of the top air-knife manifolds (24, FIG. 1) of conventional design. It must be noted that, where the high pressure air-knife manifolds of conventional design aim the air under a concentrated stream and thereby exert pressure on the surface of the assembly 10 in a very localized manner, the air-knife box 48 of the invention spreads the delivery of the air over a wide area, that is the exhaust area 50 of the air-knife box that faces the assembly 10. The pressure that is therefore exerted on the surface of the assembly 10 is distributed over a wide area and can in this manner not exert a high force on any localized section of the surface of assembly 10 or on any of the components that are mounted on that surface. One of the major sources that cause component damage or component dislodging has therefore been eliminated. Also, since the discharge region 50 of the air-knife box 48 is relatively large, the apparatus of the invention can discharge relatively large quantities of air over the surface of the assembly 10. Where the flow of air that exits the multiple air-knife box 48 needs to be increased, the pressure under which the air is released can be increased. This increase in pressure however will not result in increasing pressure on narrow, localized areas on the surface of the assembly 10 since the increased air pressure will result in an increased, finely distributed flow of air that will exit air-knife box 48 not as a massive, concentrated flow that can damage the surface of the assembly 10. It must further be noted that the apparatus of the invention has eliminated the top hold-down belt of the conventional station. The top hold-down belt of the conventional station is partially required to keep the assembly 10 in place while it passes between the two belts of the conventional cleaning station due to the high pressure that is exerted on the assembly by the high pressure air-knife manifolds (24 and 26, FIG. 1). Since, under the apparatus of the invention, the high pressure air-knife manifolds that are likely to dislodge components from the assembly 10 or the assembly itself have been partially eliminated, the constraint that has under conventional stations been provided by the top hold-down belt is no longer required. By eliminating the top hold-down belt, another cause for assembly damage has been eliminated in that the assembly or components that are contained within the assembly no longer need to be pressured in entering the space between the top (14, FIG. 1) and the bottom (18, FIG. 1) belt of conventional design.

The multiple air-knife box 48 contains the output nozzle 50, air-slots 54 and a multitude of small openings 56 that collectively form the output nozzle 50. The flow through the multiple air-knife box is as follows: the air (provided by a high-pressure blower) enters the box 48 via the main channel 52 from where it is distributed over the top surface of the output nozzle 50 via the air slots 54. Item 53 is the housing of the multiple air-knives box that, other than providing mechanical support for the various parts of the box and serving as conduit for the air channel 52, serves no function that requires further explanation.

Figure 3:
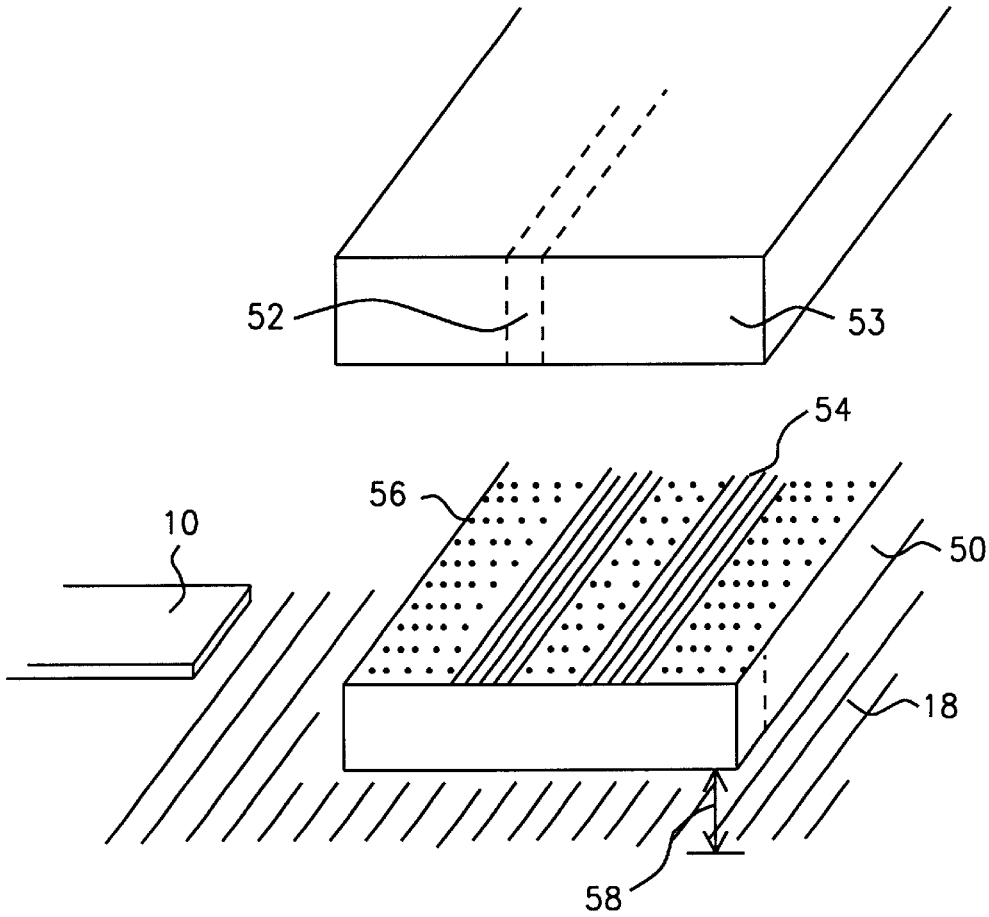
FIG. 3 shows an expanded three-dimensional view of the multi air-knives box of the invention.

The main channel 52 is, in order to allow the flow of air through this unit, cylindrical and hollow and forms a member of the air-knife box 48. Unit 52 can therefore be referred to as the hollow cylinder member of the multi-air knife box 48 of the invention. Unit 57 is the sealing unit of the multiple air-knives box in that this unit assures that no air escapes from the multiple air-knives box around the periphery of the output nozzle 50 but that all air that flows from the multiple air-knives box flows via the multiplicity of small openings 56. From the top surface of the output nozzle, the air is discharged through multiple openings 56 that are provided for that purpose in the output nozzle 50. The details of the construction of the multiple air-knife box are further highlighted under FIG. 3 following. FIG. 3 will in particular explain the existence of the air slots 54 in better detail. The air blower and other structural details of the multiple air-knife box 48 have been omitted from FIG. 2 in order to highlight only the details of the apparatus of the invention that are germane to the invention.

Cutout 55 that is shown in FIG. 2 further highlights the more salient details of the flow of air under the multiple air-knife box 48 of the invention. The exit 50 of the multiple air-knife box 48 contains an arrangement of multiple openings that all aim at distributing the air stream into multiple sub-streams while also aiming the air that exits the multiple air-knife box 48 at the surface of the assembly 10. Air flow 51 that is aimed at the top surface of the assembly 10 is, because this air flow 51 is not concentrated in relatively massive channels of flow, readily distributed (59) over the surface of the assembly 10. It is to be noted from cutout 55 that the original bottom air-knife manifolds 26 remain in place.

Further shown in FIG. 2 are the source 60 for high pressure air and the heater 62 through which the air is passed and is being heated before being entered into the main channel 52 of the air-knife box 48. Exit 64 of the heater unit 62 is connected to the main channel 52 of the air-knife box 48.

FIG. 3 shows an expanded three-dimensional view of the multi air-knives box of the invention. The main air channel 52 that is contained in the housing 53 of the multiple air-knives box 48 is clearly visible as are the slots 54 that are provided to distribute the air from the main channel 52 to the multiplicity of small openings 56. The slots 54 are typically 0.5 mm deep while the pitch between the slots is about 5 mm. The height of the output nozzle 50 is about 10 mm while each of the openings 56 have a diameter of about 1.2 mm and a pitch of about 5 mm. The dimension 58 is the blow height, that is the distance between the bottom of the output nozzle 50 and the surface of the belt 18 on which the assembly 10 is transported through the drying chamber. This dimension is typically kept at about 10 mm in order to avoid the "back pressure" effect whereby the flow that exits the output nozzle 50 is seriously hampered by air that is reflected from the surface of the assembly 10.

In sum, the apparatus of the invention eliminates the yield detractors of:

- damaged or dislodged components due to concentrated impact of drying air on the surface of the assembly that is being dried
- damaged or dislodged components due to pressing the assembly between two belts, belts that under conventional design are required to counteract the concentrated impact of drying air on the surface of the assembly
- dented solder balls due to pressing the assembly between two belts
- parts lifted from the surface of the transport belt due to concentrated air delivery, and
- parts being dragged over the surface of the transportation belt causing scratching of parts during drying.

Although the invention has been described and illustrated with reference to specific illustrative embodiments thereof, it is not intended that the invention be limited to those illustrative embodiments. Those skilled in the art will recognize that variations and modifications can be made without departing from the spirit of the invention. It is therefore intended to include within the invention all such variations and modifications which fall within the scope of the appended claims and equivalents thereof.

What is claimed is:

1. An apparatus for removing moisture from a water-based flux on the surface of assemblies that are moving through a drying station, said apparatus to comprise:

a high-pressured gas delivery apparatus;

a heating apparatus for heating the high-pressured gas; and a multi air-knife box comprising a hollow cylindrical member having a first end in addition to having a second end, said multi air knife box further comprising an air distribution nozzle, said first end of said hollow cylindrical member being connected to said high-pressured gas delivery apparatus, said second end of said hollow cylindrical member being connected to said air distribution nozzle, said air distribution nozzle directing said heated and pressurized gas at said water based flux, said air distribution nozzle comprising air distribution slots having a first end in addition to having a second end, said air distribution nozzle further comprising a multiplicity of narrow openings, said first end of said air distribution slots being connected said second end of said hollow cylindrical member, said second end of said air distribution slots being connected to said multiplicity of narrow openings that function as multiple air-knives.

2. The apparatus of claim 1 wherein said high-pressured gas is a gaseous substance used to dry electronic assemblies.

3. The apparatus of claim 1, said assembly of said multi air-knife box containing said hollow cylindrical member being a first sub-assembly of said multi air-knife box, said air distribution nozzle being a second sub-assembly of said multi air-knife box, said bottom surface of said first sub-assembly being mechanically connected to the surface of said second sub-assembly, said connection forcing a gas from said first sub-assembly into said second sub-assembly, assuring that no gas escapes from an interface between said first and said sub-assembly other than through said openings in said second sub-assembly.

4. The apparatus of claim 1 wherein said air distribution slots are provided in the surface of said air distribution nozzle, a direction under which said air distribution slots are provided in said surface of said air distribution nozzle being a direction in which said assemblies move through said drying station, said air distribution slots being provided in at least two groupings of air distribution slots, each grouping comprising between 3 and 5 air distribution slots, said air distribution slots having a depth of between about 0.3 and 0.7 mm and a pitch of between about 3 and 7 mm.

5. The apparatus of claim 1, said multiplicity of narrow openings that function as multiple air-knives comprising openings essentially perpendicular to a direction in which said assemblies move through said drying station, each of said openings having a diameter of between about 1.0 and 1.4 mm and a pitch of between about 4 and 5 mm and a depth through said air distribution nozzle of between about 9 and 11 mm.

6. The apparatus of claim 1, said air distribution nozzle having a height in a direction perpendicular to a direction in which said assemblies move through said drying station of between about 9 and 11 mm and a width across a means of transportation that is used to move said assemblies through said drying station about equal to a width of said means of transportation and a length in a direction in which said assemblies move through said drying station of between about 3 to 15 times its width.

7. A method for removing moisture from a water-based flux on the surface of assemblies that are moving through a drying station, said method to comprise the steps of:

providing a high-pressured gas delivery apparatus;

providing a heating apparatus for heating the high-pressured gas; and providing a multi air-knife box, comprising a hollow cylindrical member having a first end in addition to having a second end, said multi-air knife box further comprising an air distribution nozzle, said air distribution nozzle having a first surface in addition to having a second surface, said first end of said hollow cylindrical member being connected to said high-pressured gas delivery apparatus, said second end of said hollow cylindrical member being connected to said air distribution nozzle, said air distribution nozzle directing said heated and pressurized gas at said water based flux, said air distribution nozzle comprising air distribution slots having a first end in addition to having a second end, said air distribution nozzle further comprising a multiplicity of narrow openings, said first end of said air distribution slots being connected to said second end of said hollow cylindrical member, said second end of said air distribution slots being connected to said multiplicity of narrow openings functioning as multiple air-knives.

8. The method of claim 7, said high-pressured gas being a gaseous substance used to dry electronic assemblies.

9. The method of claim 7, said assembly of said multi air-knife box comprising said hollow cylindrical member being a first sub-assembly of said multi air-knife box, said first sub-assembly having a first end in addition to having a second end, said air distribution nozzle being a second sub-assembly of said multi air-knife box, said second sub-assembly having a first surface in addition to having a second surface, said second end of said first sub-assembly being mechanically connected to said second surface of said second sub-assembly, said connection forcing a gas from said first sub-assembly into said second sub-assembly, assuring that no gas escapes from an interface between said first and said sub-assembly other than through openings in said second sub-assembly.

10. The method of claim 7, said air distribution slots being provided in the second surface of said air distribution nozzle, a direction under which said air distribution slots are provided in said second surface of said air distribution nozzle being a direction in which said assemblies move through said drying station, said air distribution slots being provided in at least two groupings of air distribution slots, each grouping comprising between 3 and 5 air distribution slots, said air distribution slots having a depth of between about 0.3 and 0.7 mm and a pitch of between about 3 and 7 mm.

11. The method of claim 7, said multiplicity of narrow openings functioning as multiple air-knives comprising openings being essentially perpendicular to a direction in which said assemblies move through said drying station, each of said openings having a diameter of between about 1.0 and 1.4 mm and a pitch of between about 4 and 5 mm and a depth through said air distribution nozzle of between about 9 and 11 mm.

12. The method of claim 7, said air distribution nozzle having a height in a direction perpendicular to a direction in which said assemblies move through said drying station of between about 9 and 11 mm and a width across a means of transportation used to move said assemblies move through said drying station being about equal to a width of said means of transportation and a length in a direction in which said assemblies move through said drying station of between about 3 to 15 times its width.

* * * * *